US005364663A

United States Patent [19]

McCune, Jr. et al.

[11] Patent Number: 5,364,663

[45] Date of Patent: * Nov. 15, 1994

[54] THERMALLY SPRAYING METAL/SOLID LUBRICANT COMPOSITES USING WIRE FEEDSTOCK

[75] Inventors: Robert C. McCune, Jr., Birmingham; Larry V. Reatherford, Warren; Matthew J. Zaluzec, Canton, all of Mich.

[73] Assignee: Ford Motor Company, Dearborn, Mich.

[ * ] Notice: The portion of the term of this patent subsequent to Mar. 16, 2010 has been disclaimed.

[21] Appl. No.: 998,074

[22] Filed: Dec. 28, 1992

Related U.S. Application Data

[63] Continuation of Ser. No. 909,832, Jul. 7, 1992, Pat. No. 5,194,304.

[51] Int. Cl.[5] ..... B05D 3/06

[52] U.S. Cl. ..... 427/449; 427/224; 427/225; 427/249; 427/250; 427/255.2; 427/376.3; 427/376.4; 427/376.6; 427/383.7; 427/422; 427/427; 427/450; 427/451; 427/454; 427/456; 427/540; 427/580

[58] Field of Search ..... 427/449, 450, 451, 456, 427/376.3, 376.4, 376.6, 580, 224, 225, 249, 250, 255.2, 383.7, 422, 427, 540, 454

[56] References Cited

U.S. PATENT DOCUMENTS 5,194,304 3/1993 McCune et al. ..... 427/449

*Primary Examiner*—Bernard Pianalto

*Attorney, Agent, or Firm*—Joseph W. Malleck; Roger L. May

[57] ABSTRACT

A method of thermally spraying a solid lubricant (i.e. graphite or BN) impregnated metal matrix onto a metal target, using the steps of: (a) creating a flame or arc into which a consummable strand is fed, the strand being constituted as a hollow sheath of metal and a core therein comprising essentially solid lubricant powder particles, the flame or arc melting the metal of such strand; (b) applying a pressurized jet of atomizing gas to the melt and included graphite particles to project a spray of molten heavy metal and graphite particles generally homogeneously distributed throughout such spray, said graphite being protected against ablation during transit from the flame or arc to the target; and (c) surface heat treating essentially only the deposit to precipitate additional graphite while densifying the metal and controlling microstructure.

2 Claims, 2 Drawing Sheets

THERMALLY SPRAYING METAL/SOLID LUBRICANT COMPOSITES USING WIRE FEEDSTOCK

This is a continuation of application Ser. No. 07/909,832, filed Jul. 7, 1992, U.S. Pat. No. 5,194,304.

BACKGROUND OF THE INVENTION

1. Technical Field

This invention relates to the art of thermally spraying metals, and more particularly to spraying metals with solid lubricant particles by cored wires.

2. Discussion of the Prior Art

Thermal spraying was initiated as early as 1910 when a stream of molten metal was poured into the path of a high pressure gas jet causing metal droplets to spray in a conical pattern onto an adjacent substrate to immediately freeze and form a coating of deformed particles in a lamellar structure. Today, there are essentially two types of thermal spraying that use wire feedstock: combustion flame spraying and electric arc spraying. In the combustion flame process, wire is fed continuously into an oxygen-fuel gas flame; high temperatures are generated after mixing with the oxygen and igniting the flame. Compressed air is directed to the molten tip of the feedstock wire to atomize and project the metal particles. In general, coatings produced by the combustion flame process are relatively high in oxides and high in porosity levels, and, due to the low particle velocity (e.g., 50–100 m/sec), adhesion strength is relatively low at 5–20 MPa.

In the electric arc process, an electrical arc is struck between two wires, or, in some cases, one wire and an accompanying anode, the wire serving as a consummable electrode. The arc continuously melts the wires and compressed air is blown directly behind the point of melting to atomize and project the molten droplets to a target substrate. The droplets deform on impact and form a more adherent coating due to higher particle velocities of 150–300 $ms^{-1}$. The oxide level is medium to low and the coating exhibits overall lower porosity than flame-sprayed coatings.

It is known to use a cored steel wire feedstock, filled with wear-resistant producing ingredients and a minor proportion of graphite, to function as a consummable electrode in electric arc welding (see U.S. Pat. No. 4,071,734). It is also known to arc-spray cored steel wire feedstock, filled with hard carbide particles or CrBSi (see "Arc Spraying of Cored Wires", K-H. Busse, SPRAYTECH GmbH, FRG, Internal Proceedings of Thermal Spray Technology, June, 1989, Paper 36, pages 19–28). However, such wire feedstock is not suitable for use in thermal spraying of solid lubricant particles because essentially all the cored ingredients dissolve in the melted wire forming an alloy that does not possess lubricity and because such cored ingredients (carbonates, fluorides, carbides, silicates) are undesirable for the purposes of this invention. Thermal sprayed coatings of a composite material have also been accomplished by forming the entire feed wire of a metal matrix composite such as aluminum containing fibrous or particulate $TiO_2$, $Al_2O_3$, $SiO_2$, $Zr_2O_3$, SiC, or $Si_3N_4$ (see U.S. Pat. No. 4,987,003). But such technique fails to provide deposition of discrete solid lubricant particles in a metal matrix.

Solid lubricants, particularly graphite, are difficult to dispense and integrate to an independent molten metal body without dissolution. Adding such graphite powder to the flame or arc-spray process, either upstream or downstream of the location where the wire melts, may not necessarily result in the intended graphite concentrations in the coating and, further, may fail to minimize ablation of the graphite as it is exposed to the projecting gases or molten metal.

SUMMARY OF THE INVENTION

The invention is a method of thermally spraying a metal matrix composite containing solid lubricant particles. It comprises essentially: (a) creating a flame or arc into which a consummable metal strand is fed to produce a melt, the strand being constituted as a hollow sheath of metal and a core containing melt-resistant solid lubricant particles; (b) applying a pressurized jet of propellant gas to the melt and particles to project a spray thereof while protecting the particles against ablation during transit of the spray to a target to deposit a coating; and (c) heat treating essentially only the deposit to precipitate additional solid lubricant particles, control microhardness, and densify the metal. Ablation comprehends the loss of solid lubricant by oxidation or dissolution into the metal.

DETAILED DESCRIPTION AND BEST MODE

Figure 1:
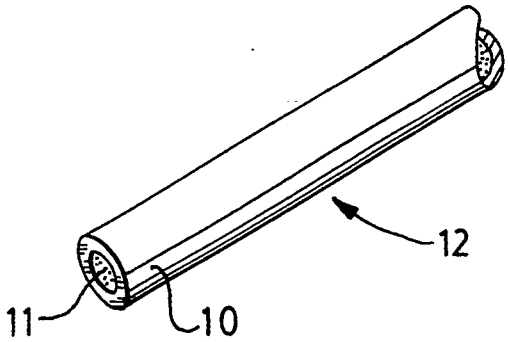
FIG. 1 is a perspective view of a hollow core heavy metal strand within which is contained powder graphite, said strand being useful in carrying out the thermal spray method of this invention.

The invention is a method of thermal spraying a solid-lubricant impregnated metal matrix composite by first creating a flame or electric arc 13 into which a consummable strand 14, 15 is fed to produce a melt 21, the strand 14, 15 being constituted as a hollow sheath of metal (such as iron, aluminum, molybdenum, nickel, copper, or iron alloyed with nickel or molybdenum and copper-nickel alloys) and a core 11 comprising essentially solid lubricant or second phase particles that are melt-resistant (such as graphite and boron nitride), the flame or arc 13 melting the metal of the strand; secondly, applying a pressurized jet of propellant gas to the melt 21 and to the adjacent particles to project a spray 18 of molten metal and solid lubricant particles generally homogeneously distributed throughout such spray, the particles being protected during their transit to the target against ablation; and thirdly, surface heat treating essentially only the deposited coating to precipitate additional solid lubricant particles, control the coating microstructure, and densify the metal.

Figure 2:
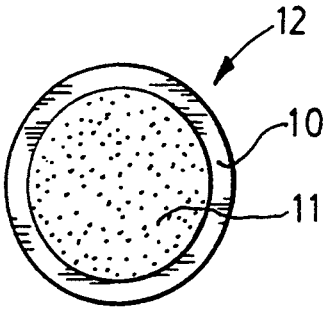
FIG. 2 is an enlarged cross-section of said strand.

This method is particularly useful in depositing a simulated cast iron coating containing graphite onto metal substrates, such as automotive components made of aluminum, magnesium-based alloys, or iron-based alloys. As shown in FIGS. 1 and 2, the strand 12 is formed as a hollow member or wire 10 containing a core of essentially powder graphite 11, thus a graphite cored iron wire 12. The metal for sheath 10 can be selected from metals typically used in metal arc spraying, examples of which include iron-carbon alloys, nickel alloys, copper alloys, bronzes, aluminum alloys and iron-based alloys such as iron-nickel, iron-molybdenum, iron-chromium. It would be apparent that metals capable of being mechanically drawn into the sheath form, and are electrically conductive would generally be suitable for sheath materials. The filled hollow-core metal wire 12 is typically formed by drawing an initial U-shaped channel into which the powder is placed. For purposes of thermal spraying, the wire should have a typical diameter of 0.060"; the sheath 10 should have a radial thickness of 0.005–0.010 inches, leaving an interior space which accounts for approximately 65% of the cross sectional area of the strand. It will be apparent to those skilled in the art that the composition of the final coating and content of included particulate phase (e.g., graphite) is significantly affected by control of the sheath thickness and addition of alloying constituents to the core.

If a flame is utilized for the thermal spraying, the hollow core wire 12 containing the powder graphite 11 is fed continuously into a oxygen-fuel gas flame. Temperatures of approximately 3000° C. may be generated after mixing with the oxygen and igniting the flame. Compressed air is typically directed to the molten tip of the wire feedstock that is in the flame, and this atomizes and projects the particles across distances up to one meter. Particle velocity, as a result of the compressed air and flame, will be in the range of 50–100 $ms^{-1}$ and the deposition rate for such technique is usually low, in the range of 1–10 $kghr^{-1}$, and thus is effective for thin coatings.

Figure 3:
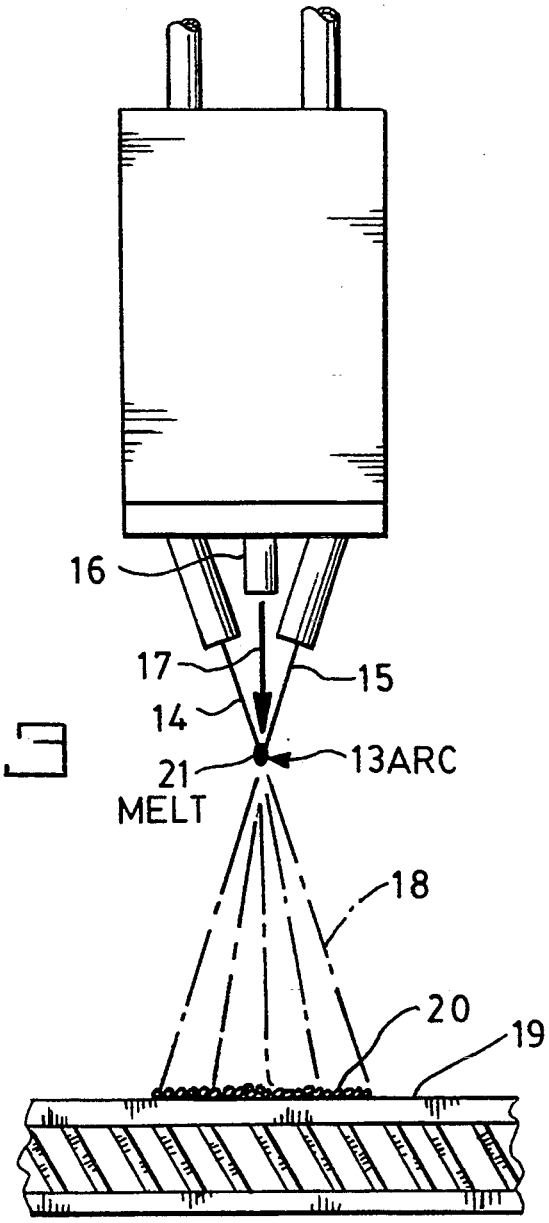
FIG. 3 is a schematic representation of an apparatus suitable for carrying out the invention herein and for utilizing the cored strand of FIG. 1.

If an electric arc is used for purposes of thermal spraying, it will melt the metal sheath 10. As shown in FIG. 3, an arc 13 can be struck between two feedstock wires 14 and 15, each of which are of the hollow strand type carrying powder graphite therein, and serving as consummable electrodes. The electrical current supplied to the arc is in the range of 90–500 amperes. The arc continuously melts the ends of the wires and pressurized atomizing gas is blown directly from a nozzle 16 along a path 17 behind the arc 13 to atomize and project the molten droplets in a conical spray 18 to the substrate or target 19. The molten particles deform on impact and adhere to form a coating 20 in the range of 0.1–2 mm. Deposits by electric arc spraying are usually more adherent (15–50 MPa adhesion) and can be sprayed to greater thicknesses because of the greater deposition rate. The temperature at the arc is in the range of 4000°–6000° C., the particle velocity in the range of 150–300 $ms^{-1}$ and deposition rates as high as 50 $kghr^{-1}$.

The pressurized jet of gas is typically compressed air at an inlet pressure of about 400–830 kPa. The force of the jet is capable of propelling the molten metal droplets and graphite particles at high velocities along, preferably, a path of no greater than about 50 cm.

At the arc, graphite is vulnerable to dissolution into the molten droplets of metal because of such high temperatures. Also, during the traverse of the conical path from the flame or arc to the target, the graphite particles are subject to ablation by oxidation. To protect such graphite particles so that they can be retained as a discrete impregnate or precipitate in the iron or metal matrix, the solid lubricant particles of graphite must be protected, first, by restricting the solubility of carbon in the spray metal; secondly, by encapsulation; thirdly, by the use of a protective inert gas shroud; fourthly, by the use of a protective metallic matrix to incorporate the graphite particles when they are formed as a core material; and fifthly, they may be oversized to allow for controlled sacrificial ablation during the flame or arc process and transfer to the substrate.

With respect to restricting dissolution of carbon, the heavy metal sheath is formed of an iron alloy containing nickel, copper, chromium and silicon, which additionally provides corrosion resistance for the coating, similar to austenitic cast iron. For example, a typical composition might include Ni—17%, Cu—8%, Si—2%, Cr—2.5%, Mn—1%, C—3%, and the balance Fe. Stability is expected to use temperatures of about 800° F.

With respect to the second protective measure, the encapsulating material, such as nickel, is formed about each of the graphite particles of a size of about four microns, in a thin shell. This process can be carried out by chemical vapor deposition from species such as nickel carbonyl in a fluidized bed process. Coatings such as silicon carbide, silicon dioxide, and boron trioxide may be also utilized as protective sheaths for graphite. The final graphite particle will be commensurate with that observed in gray or nodular cast iron.

With respect to the use of a protective shroud, gases such as argon, helium, or nitrogen may be employed to minimize the reaction of graphite with atmospheric oxygen during thermal spraying. The gas shroud can be emitted by a ring that bathes the conical spray.

A pressurized jet of propellant gas is applied to the melt and to project a spray of particles while protecting the particles against ablation during traverse of the spray to a target to deposit a coating thereon.

With respect to the use of a protective metallic matrix, this process will ensue when metal sheath materials, having a particularly strong affinity for wetting of the graphite or other second phase particle contained within the core, become molten in the arc and are in proximity to the core particles. Thus, droplets are formed from the core wire because the metal matrix will melt and coat the core particles protecting them from atmospheric ablation. Under ideal conditions, the metal sheath and core particles are chosen so that there is limited solubility of the core particles in the metal sheath material, although the sheath metal has an affinity for wetting of the core powder.

Once the composite metal/graphite layer has been deposited by the thermal spraying process, optimal microstructural and mechanical properties may be developed by post-deposition thermal processing of the near-surface region of the overlay.

Surface heat treatment is of significance. Once the dual phase metal/graphite layer has been deposited by the thermal spraying process, it is necessary to develop optimal microstructural and mechanical properties by post-thermal processing of the near-surface region of the overlay. This could be accomplished in several ways, such as: (a) laser compaction and thermal treatment which permits densification of the iron or other matrix metal layer and full precipitation of the graphite particles, controlled heat/cool cycles will develop optimal mechanical properties of the iron phase (such as pearlitic or martensitic structures) based on the application's requirements; (b) induction thermal heating of the surface layer as is conventionally practiced for cast iron or steel componentry; or (c) pulsed white light arc lamp thermal processing of the surface layer. Pulsed laser heating is disclosed in the article "Development of a Laser Surface Melting Process for Improvement of the Wear Resistance of Gray Cast Iron", A. Blarasin et al, Wear 86, 315–325 (1983).

Pulsed arc-lamp heating is disclosed in the article "Surface Treatment With a High-Intensity Arc Lamp", Advanced Materials and Processes, September, 1990.

Figure 4:
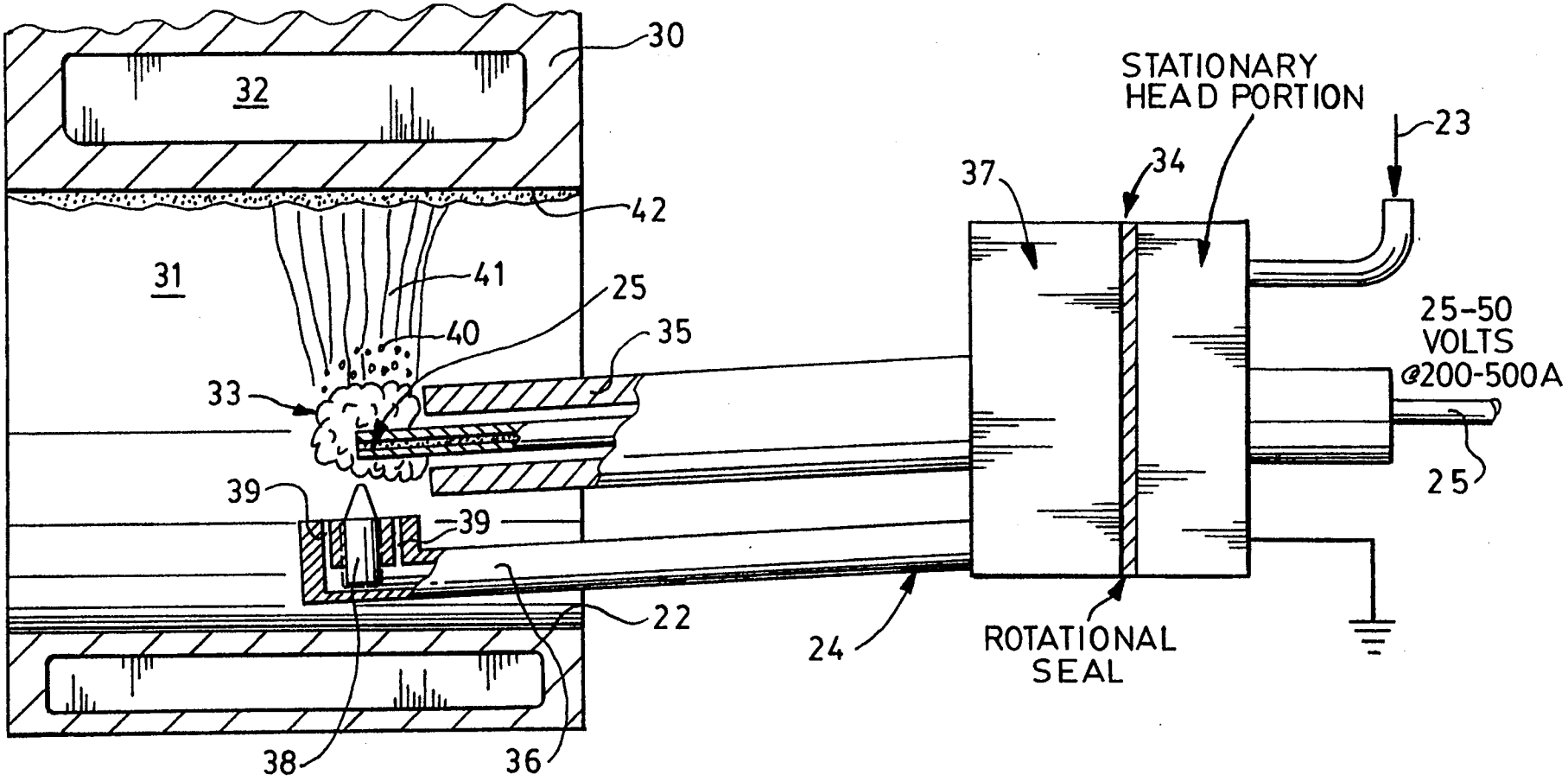
FIG. 4 is a schematic representation of an apparatus for coating the interior of engine cylinder bores, utilizing this invention.

The invention further comprehends a method of making a light metal engine block (e.g., aluminum or magnesium alloy having water passages 32) for an internal combustion engine having at least one chamber 31 for containing movement of a thrust element, such as a piston within a cylinder bore 22 (see FIG. 4). The method comprises: (a) positioning the projection end of a thermal spray device 24 within chamber 31 and adjacent the bore wall 22 as a target. The device 24 has at least one consummable cored wire 25 (e.g., steel wire cored with graphite particles) fed through a head 34 into an arc 33. The arc is struck between the end of the cored wire 25 and the tip of radially directed cathode 38. A pressurized jet of inert gas 23 is carried through an insulating tube or sleeve 35, supported by the head 34, to shroud the wire 25. An arm 36 extends from the head parallel to but spaced from sleeve 35; arm 36 is supported by a rotating portion 37 of head 34. A non-consummable tungsten cathode 38 is carried by the arm and directed radially. The cathode is surrounded by a curtain of pressurized gas jets 39, which gas projects the molten droplets 40 of melted rod along a spray pattern 41. The arm 36 is rotated about sleeve 35 to cause the spray 41 of molten metal and graphite to traverse (both axially and circumferentially) across a predetermined amount of the chamber interior to deposit a coating 42 in the thickness range of 0.1–2 mm. Finally, the block and cylinder bore carrying the deposited coating is subjected to a surface heat treatment so that additional graphite is precipitated and the metal is densified thus forming a synthetic cast iron. Such sprayed interior of the aluminum block will have a robust wear resistant coating attached thereto which has a strong adherence as a result of the thermal spray process and carries self-lubricating properties because of the presence of the graphite particles in the iron or heavy metal matrix.

We claim:

1. A method of thermally spraying a metal matrix coating containing solid lubricant particles, comprising:

(a) creating a flame or electrical arc into which a consummable strand is fed to produce a melt, the strand being constituted as a hollow sheath of metal meltable by said flame or arc and in which is disposed a core containing solid lubricant melt-resistant particles; and (b) applying a propellant gas to said melt and particles to project a spray thereof while protecting said particles against ablation during transfer of said spray to a target to deposit a coating thereon.

2. A method of making a lightweight engine block for an internal combustion engine having at least one chamber for containing movement of a thrust element, comprising:

(a) forming a lightweight metal engine block for containing movement of a thrust element;

(b) positioning a thermal spray device adjacent the interior of said chamber as a target, said device having at least one consummable electrode to establish an arc therewith, said consumable electrode being comprised of a hollow sheath of metal with a core of melt-resistant solid lubricant particles;

(c) striking said arc and applying a pressurized jet of atomizing gas immediately behind said arc to project molten droplets of metal as a spray and containing homogeneously distributed graphite particles therein; and (d) manipulating said device to cause said spray to traverse longitudinally and radially across a predetermined extent of said chamber interior to deposit a coating thereon.

* * * * *